US006666431B2

(12) United States Patent
McCusker

(10) Patent No.: US 6,666,431 B2
(45) Date of Patent: Dec. 23, 2003

(54) REMOTE WATER CONTROL VALVE

(76) Inventor: Leo McCusker, 16 Cote Cir., Raymond, NH (US) 03077

( * ) Notice: Subject to any disclaimer, the term of this patent is extended or adjusted under 35 U.S.C. 154(b) by 0 days.

(21) Appl. No.: 10/073,759

(22) Filed: Feb. 11, 2002

(65) Prior Publication Data

US 2003/0151013 A1 Aug. 14, 2003

(51) Int. Cl.[7] ..... F16K 31/06
(52) U.S. Cl. ..... 251/129.15; 251/129.04
(58) Field of Search ..... 251/129.01–129.22

(56) References Cited

U.S. PATENT DOCUMENTS 4,411,406 A * 10/1983 Inada et al. ..... 251/282
4,593,881 A * 6/1986 Yoshino ..... 251/129.11
4,791,958 A * 12/1988 Brundage ..... 251/129.18
5,213,303 A * 5/1993 Walker ..... 251/129.17
5,575,311 A * 11/1996 Kingsford ..... 251/129.17
6,047,417 A * 4/2000 Derakhshan ..... 251/296
6,076,801 A * 6/2000 DuHack et al. ..... 251/129.15
6,337,635 B1 * 1/2002 Ericksen et al. ..... 251/129.04

* cited by examiner

*Primary Examiner*—Paul J. Hirsch
(74) *Attorney, Agent, or Firm*—Joseph E. Funk

(57) ABSTRACT

An electrically controlled flow valve is disclosed that is co-located with a manually operated, remote, water supply flow valve to control the flow of water through a hose from the water supply valve to an appliance such as a washing machine. A controller in the appliance controls the new flow valve to control the flow of water to the appliance, and isolates water pressure from the hot and cold water supply lines from the hoses and the washing machine when the appliance is not in use. Any hose leak that may occur when the alliance is not in use is limited to the small amount of water that normally lies in the hoses.

8 Claims, 2 Drawing Sheets

REMOTE WATER CONTROL VALVE

FIELD OF THE INVENTION

The present invention related to appliances that use water and more particularly to electrically operated flow control valves used with such appliances.

BACKGROUND OF THE INVENTION

Power operated mixing and flow control valves are employed where it is desired to mix fluid from a heated and unheated source to produce a fluid mixture of hot, cold and warm temperatures for an appliance that utilizes water. In particular, power operated valves of this type are employed in domestic laundry appliances, such as clothes washing machines, to control the filling of water in the wash tub, particularly those of the type having a tub with a motor driven agitator. In the typical household washing machine an electrically operated valve assembly has attached to one inlet thereof the household cold water supply and to a second inlet thereof the hot water heater. Upon being energized by the washing machine control circuitry, the electrically operated valve assembly admits either cold, hot or a mixture of the hot and cold water into the washing machine tub.

More particularly, these mixing and flow control valves are located inside a washing machine and are controlled by the control circuitry therein. Mounted on or in the wall adjacent to where a washing machine is located are conventional cold and hot water outlets with manually operated shutoff valves. As is well known in the art, one end of hoses of three foot to four foot in length are screwed onto the wall mounted cold and hot water outlets and the other end of the hoses are screwed onto the respective ones of the cold and hot water inlets of the mixing and flow control valves of the washing machine.

When a washing machine is not in use the manually operated shutoff valves should be placed in their shutoff state, but this is seldom if ever done. As a result water pressure is always present in the hoses connected between the manually operated shutoff valves and the washing machine mixing and flow control valves. Over time the metal rotating screw-on fittings on the end of the hoses become rusted and/or the material from which the hoses are fabricated degrades and a leak occurs. The result is water damage since there is nothing inhibiting water from flowing. The hoses connected to the water feed lines are pressurized.

Too often the electrically operated mixing and flow control valve inside a washing machine also degrade and fail due to age and the vibrations and temperatures inside the washing machine. When this valve leaks the result is water damage since there is nothing inhibiting water from flowing. The hoses connected to the water feed lines are pressurized.

These are two common areas in which water leaks occur in washing machines. Thus, there is a need for means to minimize or prevent the leakage problems and resulting damage in the prior art described the previous paragraphs.

SUMMARY OF THE INVENTION

In accordance with the teaching of the present invention apparatus is provided to minimize or prevent the problems in the prior art described in the Background of the Invention.

Separate electrically operated flow control valves are provided that screw directly onto the threaded outlet of each of the wall mounted manually operated water supply shutoff valves. The manually operated water supply shutoff valves remain in their open state as they typically are now. An inlet side of one of these new flow control valves is screwed onto each of the hot and cold water supply outlets. The hoses that are normally screwed directly onto the manually operated water supply shutoff valves are now screwed onto an outlet side of the new electrically operated flow control valves.

When these new flow control valves are not in their operated state, which is the state they are automatically in when the washing machine is not in use, the water pressure from the hot and cold water supply lines is isolated from the hoses and the washing machine. Any leak that may occur is limited to the small amount of water that lies in the hoses.

One end of a well insulated pair of wires is molded directly into the housing of the new flow control valve where it is electrically connected to a coil of a solenoid that controls the operation of the new valve. The other end of the wires are electrically connected in parallel to the control wires of the corresponding water mixing and flow control valve inside the washing machine, so that when the washing machine cold water mixing and flow control valve is operated the new, external cold water flow control valve is also operated, and when the washing machine hot water mixing and flow control valve is operated the new, external hot water flow control valve is also operated.

The new flow control valves may be retrofit to an existing washing machine in the manner described in the previous paragraph, or the conventional electrically operated mixing and flow control valve inside a washing machine may be eliminated and only the external flow control valves are utilized for cost savings. In the latter case an appropriate electrical connector is provided on the rear of the washing machine to which the control wire from the new hot and cold water flow control valves mounted external to the washing machine are connected. In that manner the washing machine control circuitry may selectively energize the remote water flow control valves to supply hot water, cold water, or a mixture of the two.

DESCRIPTION OF THE DRAWING

The invention will be better understood upon reading the following Detailed Description in conjunction with the drawing in which.

DETAILED DESCRIPTION

Figure 1:
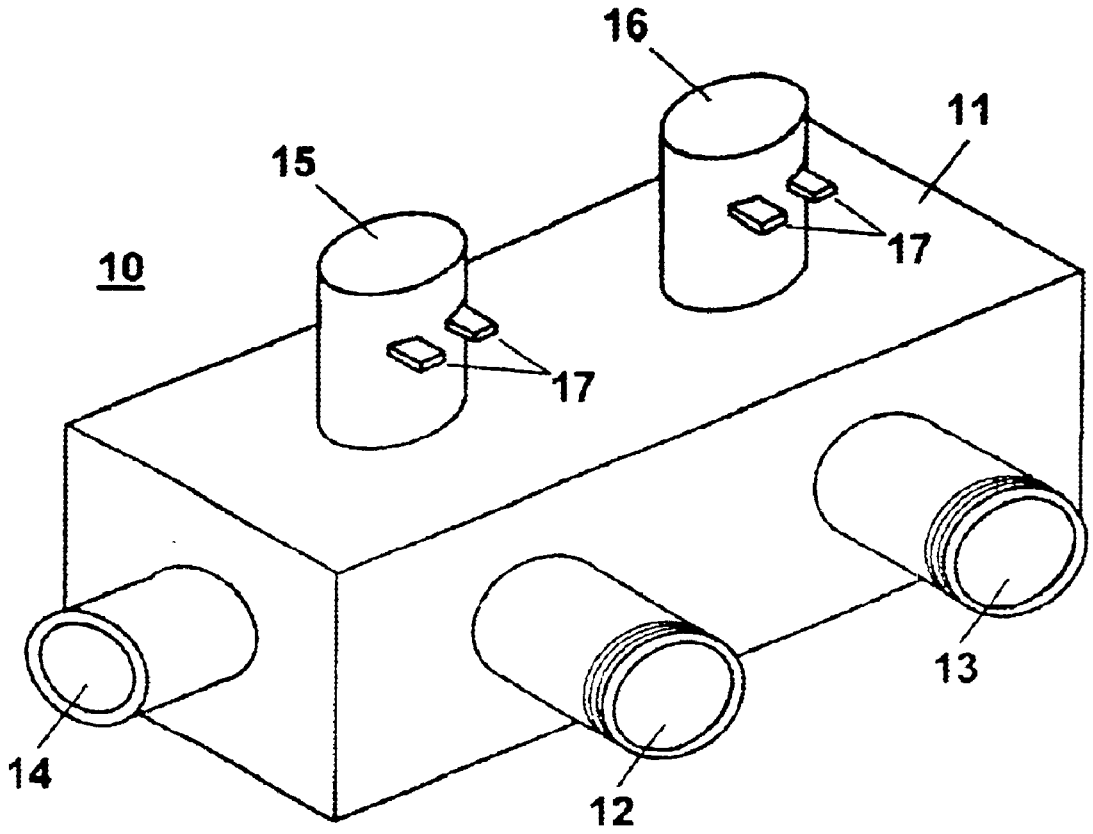
FIGURE 1 (prior art)
FIG. 1 shows a prior art mixing and flow control valve used in washing machines.

In FIG. 1 is shown a prior art mixing and flow control valve unit 10 used in clothes washing machines. These valves are typically molded of plastic and contain both a hot water and cold water flow valve. There is typically a main body 11 protruding from the sides of which are a male threaded portion 12 to which the hot water hose is screwed onto, and a male threaded portion 13 to which the cold water hose is screwed onto. There is typically a pipe 14 to which another hose (not shown) is fastened using a hose clamp. Cold water, hot water or a mixture of the two exit valve unit 10 via pipe 14 and travel through the hose to the tank (not shown) in the washing machine.

Integral to mixing and flow control valve unit 10 are two electrically operated solenoids 15 and 16 that are used to respectively open the individual hot and cold valves in valve unit 10. A coil in each of solenoids 15 and 16 is accessed via electrical terminals 17 using push on connectors in a manner well known in the art. Mating connectors from a wiring harness internal to the washing machine 20 are connected to these terminals. There is typically a metal bracket (not shown) that is part of valve unit 10 and is used to mount valve unit 10 to the frame of the washing machine.

Figure 2:
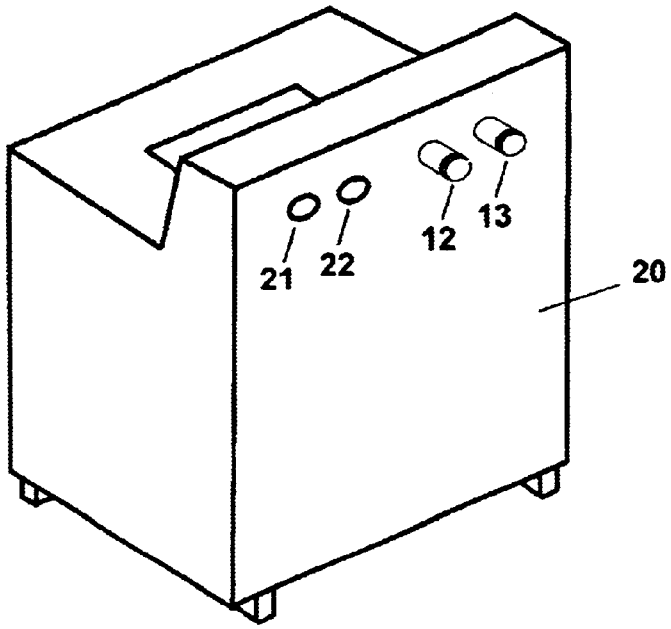
FIG. 2 is a simplified view other rear of a washing machine.

In FIG. 2 is shown a simplified view of the rear of a clothes washing machine 20. There is shown the male threaded hot and cold water portions 12 and 13 of valve unit 10 (FIG. 1) mounted inside washing machine 20. There is also shown electrical connectors 21 and 22 that may be installed in new washing machines 20 in which the conventional internal mixing and flow control valve unit 10 has been eliminated in favor of a pair of new, externally mounted, flow control valves 25 shown in and described with reference to FIG. 3.

Figure 3:
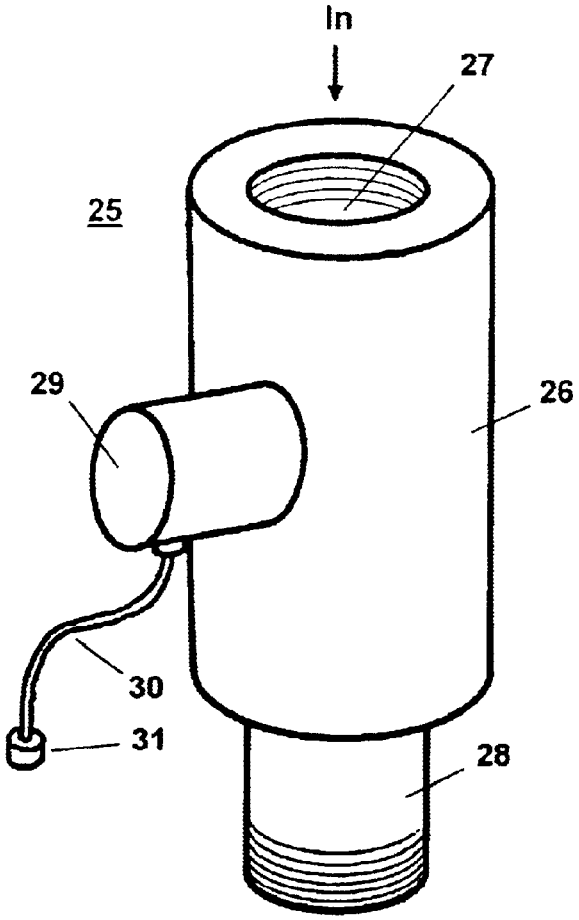
FIG. 3 shows the new water control valve.

In FIG. 3 is shown a new flow control valve 25 in accordance with the teaching of the present invention. Valve 25 has a main body 26 with an electrically operated solenoid 29 on its side for actuating a valve internal to body 26. The internal valve is not shown but is identical to those found in conventional mixing and flow control valves presently used in washing machines. Solenoid 29 and how it operates the internal valve is identical to those found in conventional mixing and flow control valves presently used in washing machines. By having all these parts the same as are presently in use minimizes the cost of manufacturing the new valve 25.

In one end of main body 26 of valve 25 is a threaded hole 27. The hole diameter and threading are identical to the metal ends of the water hoses so valve 25 can be turned onto the threaded outlet of standard wall mounted, manually operated, water outlet valves. The opposite end of body 26 has a threaded extension 28. Its diameter and threading are identical to the threaded outlet of standard wall mounted, manually operated, water outlet valves so the metal end of the hose removed from the standard wall mounted water outlet valve can be re-screwed onto threaded extension 28.

One end of a well insulated pair of wires in cable 30 are molded directly into the solenoid housing 29 of the new flow control valve 25 where they are electrically connected to a coil of a solenoid that controls the operation of the new valve in a manner well-known in the art. Cable 30 may have a relatively hard, flexible shield around it as necessary to pass Underwriters Laboratories requirements for safety.

Two valves 25 are needed for a typical installation, one for the standard, wall mounted, manually operated cold water feed valve and one for the hot water feed valve. First, the hoses are removed from the manually operated hot and cold water feed valves on the wall. Then, a valve 25 is turned onto the mating threads of each of the cold and hot water valves via its threaded hole 27. Pipe thread dope of tape should preferably be placed on the threads of the wall mounted water feed pipes before screwing a new flow control valve 25 thereon.

Next, the loose ends of the connecting hoses (not shown) are screwed onto the mating threaded end 28 of the valves 25. That is, the cold water hose from washing machine 20 will be screwed onto the new valve 25 that is now on the cold water feed valve on the wall. Then, the hot water hose from washing machine 20 will be screwed onto the new valve 25 that is now on the hot water feed valve on the wall. Water will then flow from the wall mounted feed valves, through a new valve 25, through the hoses, then through the mixing and flow control valve 10 inside washing machine 20 to the washing machine top.

When these new flow control valves 25 are not in their operated state, which is the state they are automatically in when the washing machine is not in use, the water pressure from the hot and cold water supply lines is isolated from the hoses and the washing machine. Any leak that may occur is limited to the small amount of water that lies in the hoses.

The electrical connections to the new flow control valves 25 must then be made. The wires from each new flow control valve 25 must be connected in parallel with the two wires connected to the two terminals 17 of solenoid 15 or 16 of valve unit 10. In a retrofit installation the two wires from the new flow control valve 25 screwed onto the cold water feed valve on the wall must be connected in parallel with solenoid 16 of the cold water valve in mixing and flow control valve unit 10, and the two wires from the new flow control valve 25 screwed onto the hot water feed valve on the wall must be connected in parallel with solenoid 15 of the hot water valve in mixing and flow control valve unit 10.

When the new flow control valves 25 are provided as part of a retrofit kit to an existing washing machine, electrical connectors 21 and 22 will not be at the rear of washing machine 20. To install the retrofit kit a hole (not shown) is drilled through the rear of washing machine 20, an insulating grommet (not shown) is mounted in the hole to protect wires 30 passing through the hole from being frayed or cut, and wires in cable 30 from the exterior mounted hot and cold flow control valves 25 are passed through the grommet. Interior to washing machine 20, the retrofit electrical connections may be accomplished in at least two different ways. Individual ones of the two wires in cable 30 may be connected in parallel with the wires of the corresponding water control valve in valve unit 10. That is, the wires from new hot flow control valve 25 are connected in parallel with the two wires already pushed onto the two terminals 17 of solenoid 15 that controls the hot water valve in valve unit 10 using crimp on connectors that are known in the art. These crimp connectors crimp around the insulation of the wire and have a pointed member that penetrates the insulation to contact the interior wires. Similarly, the wires from the new cold flow control valve 25 are connected in parallel with the two wires connected to the two terminals 17 of solenoid 16 that controls the cold water valve in valve unit 10 using crimp on connectors.

Alternately, the female connectors pushed onto male connectors 17 may be pulled off, and an adapter connector (not shown) is used. An adapter connector is pushed onto each of terminals 17. The adapter connectors each have a female portion that is pushed onto one of terminals 17 and two opposing male connectors. One male connector is for connecting the wire that was originally removed from terminal 17, and the other male connector is for a female connector on the end of one of the wires that make up wire cable 30 from a new flow control valve 25.

The conventional electrically operated mixing and flow control valve inside a washing machine may be eliminated and only the external flow control valves utilized for cost savings on new washing machines. In that case appropriate electrical connectors 21 and 22 (FIG. 2) are provided on the rear of the washing machine to which the control wires from the new hot and cold water flow control valves mounted external to the washing machine are connected. In that manner the washing machine control circuitry may selectively energize the remote water flow control valves to supply hot water, cold water, or a mixture of the two.

While what has been described herein is the preferred embodiment of the invention, it should be appreciated that numerous changes may be made without departing from the spirit and scope of the invention. For example, in FIG. 2 while hole 27 of new flow control valve is a tapped hole in the housing, a more conventional screw on connector, such as on the ends of the hoses, may be utilized. Further, while individual new flow control valves 25 are described herein, similar to a prior art mixing and flow control valve 19, the two new valves 25 may be combined into a single unit. Further, while the appliance that is referenced herein is a clothes washing machine, the invention may also be used with other appliances such as a dishwasher, and the water supply to an ice maker.

What is claimed is:

1. An electrically controlled flow valve controlling the flow of a fluid via a hose from a remote fluid supply to an appliance, the flow valve comprising:

first means for connecting the flow valve to the remote fluid supply;

second means for connecting the flow valve to the hose that will carry the fluid to the appliance; and means for operating the flow valve to selectively control the flow of the fluid from the remote fluid supply to the appliance via the hose;

wherein the flow valve is co-located remotely with the remote fluid supply and wherein the appliance controls the operation of the operating means to control the flow valve.

2. The invention in accordance with claim 1 wherein the appliance has a controller, and further comprising means for electrically connecting the appliance controller to the remote flow valve operating means to selectively operate the flow valve to control the flow of the fluid from the remote fluid supply to the appliance via the hose.

3. The invention in accordance with claim 2 where the operating means comprises a solenoid that actuates the flow valve, and the solenoid is responsive to an electrical signal sent over the electrical connecting means by the appliance controller.

4. The invention in accordance with claim 3 wherein the appliance has an electrically operated flow valve controlled by the appliance controller and the electrical connecting means connects the solenoid at the remote flow valve in parallel with the appliance flow control valve so when the appliance controller operates the appliance flow valve it also operates the remote flow valve.

5. The invention in accordance with claim 3 wherein the appliance is a washing machine and the fluid is cold and hot water available at manually operated shut-off valves that are left open, and an electrically controlled flow valve is attached to each of the hot and cold water shut-off valves.

6. The invention in accordance with claim 5 wherein the hot and cold water shut-off valves each have a threaded portion onto which a washing machine hose may be fastened, and the first flow valve connecting means screws onto the threaded portion of a shut-off valve.

7. The invention in accordance with claim 6 wherein the second flow valve connecting means is threaded and the washing machine hose screws thereon.

8. The invention in accordance with claim 4 wherein the appliance is a washing machine and the fluid is cold and hot water available at manually operated shut-off valves that are left open, and an electrically controlled flow valve is attached to each of the hot and cold water shut-off valves.

* * * * *